US006258760B1

(12) United States Patent
Ozaki et al.

(10) Patent No.: US 6,258,760 B1
(45) Date of Patent: Jul. 10, 2001

(54) GREASE COMPOSITION FOR CONSTANT VELOCITY JOINT

(75) Inventors: Takahiro Ozaki; Tsutomu Yoshida; Takao Nishimura; Ryuichi Masumori, all of Tokyo; Keizo Nagasawa; Yukio Asahara, both of Shizuoka, all of (JP)

(73) Assignees: Showa Shell Sekiyu K.K., Tokyo (JP); NTN Corporation, Osaka (JP)

( * ) Notice: Subject to any disclaimer, the term of this patent is extended or adjusted under 35 U.S.C. 154(b) by 0 days.

(21) Appl. No.: 09/556,819

(22) Filed: Apr. 21, 2000

(30) Foreign Application Priority Data

Apr. 21, 1999 (JP) ..... 11-114196

(51) Int. Cl.[7] ..... C10M 115/08; C10M 141/12

(52) U.S. Cl. ..... 508/365; 508/272; 508/364; 508/379; 508/444; 508/552; 508/569

(58) Field of Search ..... 508/363, 364, 508/365

(56) References Cited

U.S. PATENT DOCUMENTS

| | | | | |
|---|---|---|---|---|
| 5,160,645 | * | 11/1992 | Okaniwa et al. | 508/363 |
| 5,207,936 | * | 5/1993 | Anzai et al. | 508/363 |
| 5,246,605 | * | 9/1993 | Vartanian | 508/363 |
| 5,585,336 | * | 12/1996 | Ozaki et al. | 508/365 |
| 5,607,906 | * | 3/1997 | Okaniwa et al. | 508/168 |
| 5,612,297 | * | 3/1997 | Kamakura et al. | 508/363 |
| 5,650,380 | * | 7/1997 | Fletcher | 508/168 |
| 5,672,571 | * | 9/1997 | Hatakeyama et al. | 508/321 |
| 5,854,183 | * | 12/1998 | Hasegawa et al. | 508/316 |
| 5,952,273 | * | 9/1999 | Suzuki et al. | 508/168 |
| 6,020,290 | * | 2/2000 | Takata et al. | 508/364 |
| 6,022,835 | * | 2/2000 | Fletcher | 508/365 |
| 6,037,314 | * | 3/2000 | Kondo et al. | 508/363 |

FOREIGN PATENT DOCUMENTS

| | | | |
|---|---|---|---|
| 5-79280 | 11/1993 | (JP) | C10M/169/06 |
| 6-57283 | 3/1994 | (JP) | C10M/169/06 |

* cited by examiner

*Primary Examiner*—Ellen M. McAvoy
(74) *Attorney, Agent, or Firm*—Sughrue, Mion, Zinn, Macpeak & Seas, PLLC

(57) ABSTRACT

The present invention relates to a grease composition for a constant velocity joint, which has a low coefficient of friction to decrease the vibrations of CVJ, which comprises a base oil, a urea thickening agent, (A) a molybdenum dialkyldithiocarbamate, (B) at least one molybdenum di(alkyl or aryl)dithiophosphate represented by formula (I):

(I)

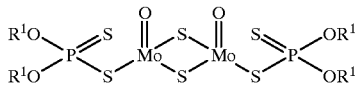

wherein $R^1$ represents a primary or secondary alkyl group or an aryl group, and (C) at least one sulfur-containing additive selected from the group consisting of an ashless dithiocarbamate, a polysulfide, zinc dithiocarbamate, sulfurized fat and oil, an olefin sulfide, a sulfur-phosphorus extreme pressure additive, and a thiadiazole extreme pressure additive, wherein each of the components (A), (B) and (C) is in an amount of 10% by weight or less based on the total weight of the grease composition.

4 Claims, No Drawings

GREASE COMPOSITION FOR CONSTANT VELOCITY JOINT

FIELD OF THE INVENTION

This invention relates to a grease composition which is suited for a sliding part of a constant velocity joint (hereinafter abbreviated as "CVJ") of automobiles.

BACKGROUND OF THE INVENTION

CVJ is a member for evenly transmitting the power of an engine to rotate right and left wheels at a given velocity. With the recent tendency to a front engine front drive (FF) system of automobiles, CVJ has shown marked development.

When a tripod type joint or a double offset type joint slides while transmitting torque, slide resistance develops in the axial direction. If this resistance is great, vibrations from the engine or the road are transmitted to the automobile body, becoming the source of vibrations of the body and booming noise. While mechanical improvements against this problem have been added to CVJ itself, the frictional resistance of CVJ can be reduced by using low-friction grease, which is effective in lessening the vibrations and noise of automobiles.

Therefore, grease to be applied to CVJ, particularly plunging type CVJ is keenly required to reduce frictional resistance of the sliding part. Grease having a low coefficient of friction is capable of reducing the friction of CVJ and thereby preventing generation of vibrations.

In order to meet the above demand, cases are increasing in the market, in which urea grease having high heat resistance and excellent frictional wear characteristics is used. The grease compositions disclosed in JP-A-6-57283 (The term "JP-A" as used herein means an "unexamined published Japanese patent application") and JP-B-5-79280 (The term "JP-B" as used herein means an "examined Japanese patent publication") can be mentioned as typical examples.

The grease composition for CVJ according to JP-A-6-57283 is urea grease containing (a) molybdenum disulfide, (b) molybdenum dialkyldithiocarbamate sulfide, and (c) a lead dialkyldithiocarbamate.

The grease composition for CVJ according to JP-B-5-79280 comprises urea grease and, as additives, a combination of molybdenum dithiocarbamate and molybdenum dithiophosphate, or a mixture of these organomolybdenum compounds and zinc dithiophosphate.

These grease compositions available from those references, especially when applied to plunging type constant velocity joints, make the induced thrust force smaller than with commercially available grease. However, vibrations occur in the shaft, and they are not regarded as satisfactory low-frictional grease.

An object of the present invention is to provide a grease composition for CVJ which has a low coefficient of friction to decrease the vibrations of CVJ.

SUMMARY OF THE INVENTION

The present inventors have extensively studied to further improve the technique of JP-B-5-79280. As a result, they have found that a combination of specific sulfur compounds with conventional techniques provides grease capable of suppressing vibrations of CVJ, i.e., grease having a lower coefficient of friction. The present invention has been completed based on this finding.

The present invention relates to a grease composition for a constant velocity joint, which comprises a base oil, a urea thickening agent, (A) a molybdenum dialkyldithiocarbamate, (B) at least one molybdenum di(alkyl or aryl)dithiophosphate represented by formula (I):

(I)

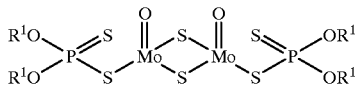

wherein $R^1$ represents a primary or secondary alkyl group or an aryl group, and (C) at least one sulfur-containing additive selected from the group consisting of an ashless dithiocarbamate, a polysulfide, zinc dithiocarbamate, sulfurized fat and oil, an olefin sulfide, a sulfur-phosphorus extreme pressure additive, and a thiadiazole extreme pressure additive, wherein each of the components (A), (B) and (C) is in an amount of 10% by weight or less based on the total weight of the grease composition. Unless otherwise indicated, all the percents are given by weight based on total weight.

In a preferred embodiment, the grease composition further comprises (D) 5% by weight or less, based on the total weight of the grease composition, of at least one zinc di(alkyl or aryl)dithiophosphate represented by formula (II):

(II)

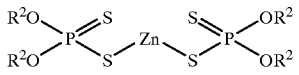

wherein $R^2$ represents a primary or secondary alkyl group or an aryl group.

The present invention also relates to a method of decreasing the coefficient of friction, which comprises adding the grease composition to a constant velocity joint, the grease composition comprising the same.

DETAILED DESCRIPTION OF THE INVENTION

The base oil which can be used in the present invention includes mineral oil, synthetic oils such as ester oils, ether oils and hydrocarbon oils, and mixtures thereof.

Any urea thickening agent, including diurea compounds, triurea compounds, tetraurea compounds, and urea-containing compounds such as urea urethane compounds and urea imide compounds, can be used.

The content of each of additives (A), (B), and (C) in the grease composition is 10% by weight or less. Even if the content is more than 10% by weight, the effects produced are the same or rather reduced. Each of the additives (A) and (B) is preferably added in an amount of 3 to 5% by weight or less. Additive (C) is preferably added in an amount of about 1% by weight. It is preferred that (A), (B) and (C) be each used in an amount of at least 0.1% by weight.

The content of additive (D) is 5% by weight, or less, preferably 3% by weight or less. Even if the content is more than 5% by weight, the effects produced are the same or rather reduced. The minimal effective content is about 0.1% by weight. Where additive (D) is used in combination with additives (A) to (C), excellent effects can be achieved even with the amount of each additive minimized. In this case, the highest efficiency can result when each additive is used in an amount of 0.5 to 3% by weight.

If desired, other optional additives, such as antioxidants, rust inhibitors, and dispersants, may be added appropriately to the grease of the present invention as far as the effects of the present invention are not impaired.

The molybdenum dialkyldithiocarbamate as additive (A) includes molybdenum diethyldithiocarbamate sulfide, molybdenum dipropyldithiocarbamate sulfide, molybdenum dibutyldithiocarbamate sulfide, molybdenum dipentyldithiocarbamate sulfide, molybdenum dihexyldithiocarbamate sulfide, molybdenum dioctyldithiocarbamate sulfide, molybdenum didecyldithiocarbamate sulfide, molybdenum didodecyldithiocarbamate sulfide, molybdenum di(butylphenyl)dithiocarbamate sulfide, molybdenum di (nonylphenyl)dithiocarbamate sulfide, oxymolybdenum diethyldithiocarbamate sulfide, oxymolybdenum dipropyldithiocarbamate sulfide, oxymnolybdenum dibutyldithiocarbamate sulfide, oxymolybdenum dipentyldithiocarbamate sulfide, oxymolybdenum dihexyldithiocarbamate sulfide, oxymolybdenum dioctyldithiocarbamate sulfide, oxymolybdenum didecyldithiocarbamate sulfide, oxymolybdenum didodecyldithiocarbamate sulfide, oxymolybdenum di(butylphenyl)dithiocarbamate sulfide, and oxymolybdenum di(nonylphenyl)dithiocarbamate sulfide, and mixtures thereof.

Examples of $R^1$ in formula (I) representing additive (B) are methyl, ethyl, propyl, butyl, pentyl, hexyl, heptyl, octyl, nonyl, decyl, dodecyl, tetradecyl, hexadecyl, octadecyl, eicosyl, docosyl, tetracosyl, cyclopentyl, cyclohexyl, methylcyclohexyl, ethylcyclohexyl, dimethylcyclohexyl, cycloheptyl, phenyl, tolyl, xylyl, ethylphenyl, propylphenyl, butylphenyl, pentylphenyl, hexylphenyl, heptylphenyl, octylphenyl, nonylphenyl, decylphenyl, dodecylphenyl, tetradecylphenyl, hexadecylphenyl, octadecylphenyl, benzyl, and phenethyl groups. The four $R^1$ 's may be the same or different.

Specific examples of additive (B) include molybdenum diethyldithiophosphate sulfide, molybdenum dipropyldithiophosphate sulfide, molybdenum dibutyldithiophosphate sulfide, molybdenum dipentyldithiophosphate sulfide, molybdenum dihexyldithiophosphate sulfide, molybdenum dioctyldithiophosphate sulfide, molybdenum didecyldithiophosphate sulfide, molybdenum didodecyldithiophosphate sulfide, molybdenum di(butylphenyl)dithiophosphate sulfide, molybdenum di(nonylphenyl)dithiophosphate sulfide, oxymolybdenum diethyldithiophosphate sulfide, oxymolybdenum dipropylhpdithiophosphate sulfide, oxymolybdenum dibutyldithiophosphate sulfide, oxymolybdenum dipentyldithiophosphate sulfide, oxymolybdenum dihexyldithiophosphate sulfide, oxymolybdenum dioctyldithiophosphate sulfide, oxymolybdenum didecyldithiophosphate sulfide, oxymolybdenum didodecyldithiophosphate sulfide, oxymolybdenum di(butylphenyl)dithiophosphate sulfide, oxymolybdenum di(nonylphenyl)dithiophosphate sulfide, and mixtures thereof.

Examples of $R^2$ in formula (II) representing additive (D) are methyl, ethyl, propyl, isopropyl, butyl, sec-butyl, isobutyl, pentyl, 4-methylpentyl, hexyl, 2-ethylhexyl, heptyl, octyl, nonyl, decyl, isodecyl, dodecyl, tetradecyl, hexadecyl, octadecyl, eicosyl, docosyl, tetracosyl, cyclopentyl, cyclohexyl, methylcyclohexyl, ethylcyclohexyl, dimethylcyclohexyl, cycloheptyl, phenyl, tolyl, xylyl, ethylphenyl, propylphenyl, butylphenyl, pentylphenyl, hexylphenyl, heptylphenyl, octylphenyl, nonylphenyl, decylphenyl, dodecylphenyl, tetradecylphenyl, hexadecylphenyl, octadecylphenyl, benzyl, and phenethyl groups. The four $R^2$'s may be the same or different.

Specific examples of additive (D) include zinc diisopropyldithiophosphate, zinc diisobutyldithiophosphate, zinc diheptylphenyldithiophosphate, and zinc di-p-nonylphenyldithiophosphate, and mixtures thereof.

The present invention will now be illustrated in greater detail by way of Examples and Comparative Examples, but it should be understood that the present invention is not to be construed as being limited thereto.

EXAMPLES 1 TO 7 AND COMPARATIVE EXAMPLES 1 TO 10

Grease composition of Examples 1–4 and Comparative Examples were prepared by adding at least one of molybdenum dialkyldithiocarbamate and molybdenum dialkyldithiophosphate or molybdenum diaryldithiophosphate, and at least one of suffer compound selected from the group consisting of an ashless dithiocarbamate, a polysulfide, zinc dithiocarbamate, sulfurized fat and oil, an olefin sulfide, a sulfur-phosphorus extreme pressure additive, to a base grease, further adding zinc dithiophosphate, and make the mixture homogeneous by a three roll will.

Base grease used in Examples and Comparative Examples are as follows.

I. Diurea Grease

One mole (295.1 g) of 4,4'-diphenylmethane diisocyanate and 2 mol (304.9 g) of octylamine were allowed to react in 5400 g of mineral oil having a kinetic viscosity (100° C.) of about 15 $mm^2$/sec, and the resulting urea compound was uniformly dispersed in the base oil to obtain grease having a penetration (25° C., 60 W, hereinafter the penetration is measured according to ASTM D217) of 283 and a dropping point of 265° C. The content of the urea compound in the grease was 10%.

II. Tetraurea Grease:

Two moles (446.05 g) of 4,4'-diphenylmethane diisocyanate, 1 mol (115.26 g) of octylamine, 1 mol (165.13 g) of laurylamine, and 1 mol (53.56 g) of ethylenediamine were allowed to react in 5220 g of mineral oil having a kinetic viscosity (100° C.) of about 15 $mm^2$/sec, and the resulting urea compound was uniformly dispersed in the base oil to obtain grease having a penetration (25° C., 60 W) of 325 and a dropping point of 253° C. The content of the urea compound in the grease was 13%.

III. Lithium Soap Grease:

Lithium 12-hydroxystearate (600 g) was dissolved and uniformly dispersed in 5400 g of mineral oil having a kinetic viscosity (100° C.) of about 11 $mm^2$/sec to obtain lithium soap grease having a penetration (25° C., 60 W) of 271 and a dropping point of 198° C. The soap content in the grease was 10%.

IV. Aluminum Comlex Soap Grease

Benzoic acid (26.37 g) and stearic acid (55.80 g) were dissolved in 712 g of mineral oil having a kinetic viscosity (100° C.) of about 11 $mm^2$/sec, and 48.94 g of a commercially available cyclic aluminum oxide isopropylate liquid lubricant (Algomer (trade name), available from Kawaken Fine Chemical) was added thereto to conduct reaction. The resulting soap was uniformly dispersed to prepare grease having a penetration (25° C., 60 W) of 272 and a dropping point of >270° C. The grease had a soap content of 11%. The molar ratio of benzoic acid (EA) to stearic acid (SA), BA/FA, was 1.1, and the molar ratio of (BA+SA) to aluminum, (BA+FA)/A1, was 1.9.

The grease compositions prepared were subjected to Falex wear test under the following test conditions. The testing time was 15 minutes, and the coefficient of friction (IP 241/69) was obtained after the test. The results obtained are shown in Tables 1 and 2.

Test Condition:

Number of revolution: 290 r.p.m.

Load: 200 lb

Temperature: room temperature

Time: 15 min.

Grease: about 1 g of grease was applied to a test piece.

Note: 1) Molyvan (trade name) A, produced by R. T. Vanderbuilt Co., Inc.

2) Sakuralube (trade name) 300, by Asahi Denka Kogyo K. K.

3) Molyvan (trade name) L, by R. T. Vanderbuilt Co., Inc.

4) Vanlube (trade name) 7723, by R. T. Vanderbuilt Co., Inc.

5) TPS-32 (trade name), by elf ATOKEM

6) Vanlube (trade name) 869, by R. T. Vanderbuilt Co., Inc.

7) Lubrizol (trade name) 5006, by Lubrizol Corp.

8) Anglamol (trade name) 99M, by Lubrizol Corp.

9) Anglamol (trade name) 33, by Lubrizol Corp.

10) Lubrizol (trade name) 1395, by Lubrizol Corp.

11) Lubrizol (trade name) 1370, by Lubrizol Corp.

TABLE 1

| Example | | | 1 | 2 | 3 | 4 | 5 | 6 | 7 |
|---|---|---|---|---|---|---|---|---|---|
| Composition (wt %) | I. | Diurea Grease | 93.0 | 93.0 | 93.0 | 93.0 | 92.0 | | |
| | II. | Tetraurea Grease | | | | | | 95.0 | 94.5 |
| | III. | Lithium Soap Grease | | | | | | | |
| | IV. | Aluminum Complex Soap Grease | | | | | | | |
| | (A) | Mo-DTC[1)] | 3.0 | 3.0 | 3.0 | 3.0 | 3.0 | 3.0 | 3.0 |
| | (B) | Mo-DTP[2)] | 3.0 | 3.0 | 3.0 | 3.0 | 3.0 | | |
| | | Mo-DTP[3)] | | | | | | 1.0 | 1.0 |
| | (C) | Ashless DTC[4)] | 1.0 | | 0.5 | | | | |
| | | Polysulfide[5)] | | 1.0 | | 0.5 | | | |
| | | Zn-DTC[6)] | | | 0.5 | | | | |
| | | Sulfurized Fat & Oil[7)] | | | | | 1.0 | | |
| | | Sulfur-Phosphorus[8)] | | | | | | 0.5 | |
| | | Olefin Sulfide[9)] | | | | | | | 0.5 |
| | (D) | Zn-DTP[10)] | | | | 0.5 | 1.0 | 0.5 | |
| | | Zn-DTP[11)] | | | | | | | 1.0 |
| | | Total | 100.0 | 100.0 | 100.0 | 100.0 | 100.0 | 100.0 | 100.0 |
| Falex (IP241) Friction Coefficient | | | 0.064 | 0.070 | 0.067 | 0.056 | 0.068 | 0.070 | 0.067 |

TABLE 2

| Comparative Example | | | 1 | 2 | 3 | 4 | 5 | 6 | 7 | 8 | 9 | 10 |
|---|---|---|---|---|---|---|---|---|---|---|---|---|
| Composition (wt %) | I. | Diurea Grease | 93.0 | | | | | | | | | |
| | II. | Tetraurea Grease | | 96.0 | | | | | | | | |
| | III. | Lithium Soap Grease | | | 93.0 | 93.0 | | | 92.0 | 94.5 | | |
| | IV. | Aluminum Complex Soap Grease | | | | | 93.0 | 93.0 | | | 92.0 | 94.5 |
| | (A) | Mo-DTC[1)] | 3.0 | 3.0 | 3.0 | 3.0 | 3.0 | 3.0 | 3.0 | 3.0 | 3.0 | 3.0 |
| | (B) | Mo-DTP[2)] | 3.0 | | 3.0 | 3.0 | 3.0 | 3.0 | 3.0 | | 3.0 | |
| | | Mo-DTP[3)] | | 1.0 | | | | | | 1.0 | | 1.0 |
| | (C) | Ashless DTC[4)] | | | 1.0 | | 1.0 | | | | | |
| | | Polysulfide[5)] | | | | 1.0 | | 1.0 | | | | |
| | | Zn-DTC[6)] | | | | | | | | | | |
| | | Sulfurized Fat & Oil[7)] | | | | | | | 1.0 | | 1.0 | |
| | | Sulfur-Phosphorus[8)] | | | | | | | | | | |
| | | Olefin Sulfide[9)] | | | | | | | | 0.5 | | 0.5 |
| | (D) | Zn-DTP[10)] | 1.0 | | | | | | 1.0 | | 1.0 | |
| | | Zn-DTP[11)] | | | | | | | | 1.0 | | 1.0 |
| | | Total | 100.0 | 100.0 | 100.0 | 100.0 | 100.0 | 100.0 | 100.0 | 100.0 | 100.0 | 100.0 |
| Falex (IP241) Friction Coefficient | | | 0.079 | 0.088 | 0.114 | 0.123 | 0.111 | 0.117 | 0.139 | 0.155 | 0.128 | 0.139 |

The grease composition of the present invention which contains limited amounts of limited sulfur-containing additives achieves a lower coefficient of friction than that of JP-5-79280 and is useful as grease for CVJ, particularly plunging type CVJ.

While the invention has been described in detail and with reference to specific examples thereof, it will be apparent to one skilled in the art that various changes and modifications can be made therein without departing from the spirit and scope thereof.

This application is based on Japanese application No. Hei.11-114196 filed on Apr. 21, 1999, the entire contents of which are incorporated hereinto by reference.

What is claimed is:

1. A grease composition for a constant velocity joint, which comprises a base oil, a thickening agent comprising a urea compound, (A) a molybdenum dialkyldithiocarbamate, (B) at least one molybdenum dialkyldithiophosphate or molybdenum diaryldithiophosphate represented by formula (I):

(I)

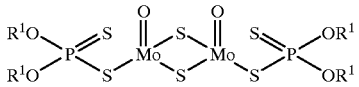

wherein $R^1$ represents a primary or secondary alkyl group or an aryl group, and (C) at least one sulfur-containing additive selected from the group consisting of an ashless dithiocarbamate, a polysulfide, zinc dithiocarbamate, sulfurized fat and oil, an olefi sulfide, a suffir-phosphorus extreme pressure additive, and a thiadiazole extreme pressure additive, wherein each of components (A), (B) and (C) is present in an amount of 10% by weight or less based on the total weight of the grease composition.

2. The grease composition according to claim 1, which further comprises (D) 5% by weight or less, based on the total weight of the grease composition, of at least one zinc dialkyldithiophosphate or zinc diaryldithiophosphate represented by formula (II):

(II)

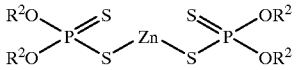

wherein $R^2$ represents a primary or secondary alkyl group or an aryl group.

3. A method of decreasing the coefficient of friction, which comprises adding a grease composition to a constant velocity joint, said grease composition comprising:

a base oil, a thickening agent comprising a urea compound, (A) a molybdenum dialkyldithiocarbamate, (B) at least one molybdenum dialkyldithiophosphate or imlybdenum diaryldithiophosphate represented by formula (I):

(I)

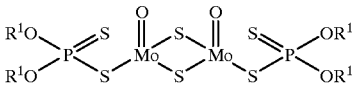

wherein $R^1$ represents a primary or secondary alkyl group or an aryl group, and (C) at least one sulfur-containing additive selected from the group consisting of an ashless ditiocarbamate, a polysulfide, zinc dithiocarbarnate, sulfrized fat and oil, an olefin sulfide, a sulfur-phosphorus extreme pressure additive, and a thiadiazole extreme pressure additive, wherein each of components (A), (B) and (C) is present in an amount of 10% by weight or less based on the total weight of the grease composition.

4. The method according to claim 3, wherein the grease composition further comprises (D) 5% by weight or less, based on the total weight of the grease composition, of at least one zinc dialkyldithiophosphate or zinc diaryldithiophosphate represented by formula (II):

(II)

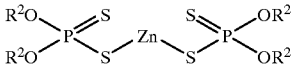

wherein $R^2$ represents a primary or secondary alkyl group or an aryl group.

* * * * *